United States Patent [19]

Monbaliu et al.

[11] Patent Number: 4,981,768

[45] Date of Patent: Jan. 1, 1991

[54] PHOTOSENSITIVE RECORDING MATERIAL HAVING AN N-ARYL CARBAZOLE P-TYPE CHARGE TRANSPORT COMPOUND

[75] Inventors: Marcel J. Monbaliu, Mortsel; David R. Terrell, Lint; Stefaan K. De Meutter, Zandhoven, all of Belgium

[73] Assignee: Agfa-Gevaert, N.V., Mortsel, Belgium

[21] Appl. No.: 370,688

[22] Filed: Jun. 23, 1989

[30] Foreign Application Priority Data

Jun. 23, 1988 [EP] European Pat. Off. ..... 88201292.5

[51] Int. Cl.[5] ..... G03G 5/14

[52] U.S. Cl. ..... 430/59

[58] Field of Search ..... 430/59, 71

[56] References Cited

U.S. PATENT DOCUMENTS 4,410,615 10/1983 Goto et al. ..... 430/59

4,521,605 6/1985 Okazaki et al. ..... 430/59

*Primary Examiner*—John L. Goodrow

*Attorney, Agent, or Firm*—A. W. Breiner

[57] ABSTRACT

An electrophotographic recording material which comprises an electrically conductive support having thereon a double layer of a charge generating layer in contiguous relationship with a charge transporting layer comprising a p-type charge transport compound corresponding to the following general formula (I):

(I)

wherein:

$R^1$ is —$NR^4R^5$, wherein each of $R^4$ and $R^5$ (same or different) represents hydrogen, an aliphatic or cycloaliphatic group including said groups in substituted form or an aryl group, or $R^4$ and $R^5$ together represent the atoms necessary to complete a nitrogen-containing ring including such ring in substituted form, or $R^1$ is N=N—Cp, wherein Cp is an azocoupler residue derived from an aromatic amine or an aromatic hydroxy compound used in azo coupling, or $R^1$ is N=CH—$R^6$, wherein $R^6$ represents an aliphatic or cycloaliphatic group including said groups in substituted form, or an aryl group, Ar presents a bivalent aromatic group including said group in substituted form, and each of $R^2$ and $R^3$ (same or different) represents hydrogen, halogen, an alkyl group, an alkoxy group or a —$NR^7R^8$ group, wherein each of $R^7$ and $R^8$ (same or different) represents an aryl group, a $C_1$–$C_{10}$ alkyl group including such alkyl group in substituted form.

10 Claims, No Drawings

PHOTOSENSITIVE RECORDING MATERIAL HAVING AN N-ARYL CARBAZOLE P-TYPE CHARGE TRANSPORT COMPOUND

DESCRIPTION

The present invention relates to a photosensitive recording material suited for use in electrophotography.

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material the photoconductive recording material is reusable. In order to permit a rapid multiple printing or copying a photoconductor layer has to be used that rapidly looses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

Another important property which determines whether or not a particular photoconductive material is suited for electrophotographic copying is its photosensitivity that must be high enough for use in copying apparatus operating with a copying light source of fairly low intensity.

Commercial usefulness further requires that the photoconductive layer has a chromatic sensitivity that matches the wavelength(s) of the light of the light source, e.g. laser or has panchromatic sensitivity when white light is used e.g. to allow the reproduction of all colours in balance.

Intensive efforts have been made to satisfy said requirements. e.g. the spectral sensitivity of selenium has been extended to the longer wavelengths of the visible spectrum by making alloys of selenium, tellurium and arsenic. In fact selenium-based photoconductors remained for a long time the only really useful photoconductors although many organic photoconductors were discovered.

Organic photoconductor layers of which poly(N-vinylcarbazole) layers have been the most useful were less interesting because of lack of speed, insufficient spectral sensitivity and rather large fatigue.

However, the discovery that 2,4,7-trinitro-9-fluorenone (TNF) in poly(N-vinylcarbazole) (PVCz) formed a charge-transfer complex strongly improving the photosensitivity (ref. U.S. Pat. No. 3,484,237) has opened the way for the use of organic photoconductors in copying machines that could compete with the selenium-based machines.

TNF acts as an electron acceptor whereas PVCz serves as electron donor. Films consisting of said charge transfer complex with TNF:PVCz in 1:1 molar ratio are dark brown, nearly black and exhibit high charge acceptance and low dark decay rates. Overall photosensitivity is comparable to that of amorphous selenium (ref. Schaffert, R. M. IBM J. Res. Develop., 15, 75 (1971).

A further search led to the discovery of phthalocyanine-binder layers, using poly(N-vinylcarbazole) as the binder [ref. Hackett, C. F. J. Chem. Phys., 55, 3178 (1971)]. The phthalocyanine was used in the metal-free X form and according to one embodiment applied in a multilayer structure wherein a thin layer of said phthalocyanine was overcoated with a PVCz layer. Hackett found that photoconductivity was due to field dependent photogeneration of electron-hole pairs in the phthalocyanine and hole injection into the PVCz. The transport of the hole carriers, i.e. positive hole conduction proceeded easily in the PVCz layer. From that time on much research has been devoted to developing improved photoconductive systems wherein charge generation and charge transport materials are separate in two contiguous layers (see e.g. U.K. Pat No. 1,577,859). The charge generating layer may be applied underneath or on top of the charge transport layer. For practical reasons, such as less sensitivity to wear and ease of manufacture, the first mentioned arrangement is preferred wherein the charge generating layer is sandwiched between a conductive support and a light transparent charge transport layer (ref. Wolfgang Wiedemann, Organische Photoleiter - Ein Uberblick, II, Chemiker Zeitung, 106. (1982) Nr. 9 p. 315).

In order to form a photoconductive two layer-system with high photosensitivity to the visible light dyes having the property of photo-induced charge generation have been selected. Preference is given to a water-insoluble pigment dye of e.g. one of the following classes:

(a) perylimides, e.g. C.I. 71 130 (C.I. = Colour Index) described in DBP 2 237 539, (b) polynuclear quinones, e.g. anthanthrones such as C.I. 59 300 described in DBP 2 237 678, (c) quinacridones, e.g. C.I. 46 500 described in DBP 2 237 679, (d) naphthalene 1,4,5,8-tetracarboxylic acid derived pigments including the perinones, e.g. Orange GR, C.I. 71 105 described in DBP 2 239 923, (e) phthalocyanines, e.g. $H_2$-phthalocyanine in X-crystal form (X-$H_2$Ph), metal phthalocyanines, e.g. CuPc C.I. 74 160 described in DBP 2 239 924 and indium phthalocyanine described in U.S. Pat. No. 4,713,312.

(f) indigo- and thioindigo dyes, e.g. Pigment Red 88, C.I. 73 312 described in DBP 2 237 680, (g) benzothioxanthene-derivatives as described e.g. in DAS 2 355 075, (h) perylene 3,4,9,10-tetracarboxylic acid derived pigments including condensation products with o-diamines as described e.g. in DAS 2 314 051, (i) polyazo-pigments including bisazo-, trisazo- and tetrakisazo-pigments, e.g. Chlordiane Blue C.I. 21 180 described in DAS 2 635 887, and bisazopigments described in DOS 2 919 791, DOS 3 026 653 and DOS 3 032 117, (j) squarilium dyes as described e.g. in DAS 2 401 220, (k) polymethine dyes.

(l) dyes containing quinazoline groups, e.g. as described in GB-P 416 602 according to the following general formula:

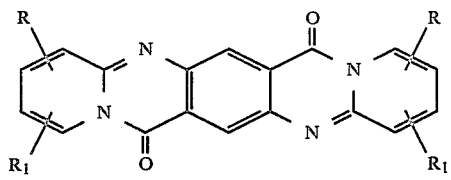

in which R and $R_1$ are either identical or different and denote hydrogen, $C_1$–$C_4$ alkyl, alkoxy, halogen, nitro or hydroxyl or together denote a fused aromatic ring system, (m) triarylmethane dyes, and (n) dyes containing 1,5 diamino-anthraquinone groups.

The charge transporting layer can comprise either a polymeric material or a nonpolymeric material. In the case of nonpolymeric materials the use of such materials with a polymeric binder is generally preferred or required for sufficient mechanical firmness and flexibility. This binder may be "electronically inert" (that is incapable of substantial transport of at least one species of charge carrier) or can be "electronically active" (capable of transport of that species of charge carriers that are neutralized by a uniformly applied electrostatic charge). For example, in the arrangement: conductive support—charge generating layer—charge transport layer, the polarity of electrostatic charging that gives the highest photosensitivity to the arrangement has to be such that negative charging is applied to a hole conducting (p-type) charge transport layer and positive charging is applied to an electron conducting (n-type) charge transport layer.

Since most of the organic pigment dyes of the charge generating layer provide more efficient hole injection than electron injection across a field-lowered barrier at the interface where pigment-dye/charge transport compounds touch each other and possibly form a charge transfer complex there is a need for charge transport materials that have a good positive hole transport capacity for providing an electrophotographic recording system with low fatigue and high photosensitivity.

According to the already mentioned article "Organische Photoleiter - Ein Uberblick"; II of Wolfgang Wiedemann, p. 321, particularly efficient p-type transport compounds can be found in the group consisting of heteroaromatic compounds. hydrazone compounds and triphenylmethane derivatives. Examples of double layer systems containing hydrazone compounds as charge transporting substance are described in U.S. Pat. Nos. 4,278,747 and 4,365,014. Examples of triphenylmethane derivatives that are particularly useful as charge transporting compounds in a double layer photoconductive system are given in U.S. Pat. Nos. 4,140,529 and 4,330,608.

The use of triarylalkane organic photoconductors in single layer photoconductive materials was already known from U.S. Pat. No. 3,542,544 corresponding to German Auslegeschrift (DAS) 1 237 900.

The use of photoconductive heteroaromatic compounds such as N-(4-amino-aryl)carbazole compound in single layer photoconductive materials is described in U.S. Pat. No. 3,912,509.

Compounds that are known for use as photoconductive materials in photoconductive single layer systems are not automatically particularly suited for use in the described two-layer system since such will be dependent on their capability of p-type charge transport which cannot ba assessed by simply considering their chemical structure but has to be established by experiment using said photoconductive compounds in a layer in contiguous relationship with a charge generating layer that provides electron-positive hole pairs on photo-exposure.

For example photoconductive 1,2-bis(1,2,3,4-tetrahydroquinolin-1-yl)ethane and 1,2-bis(1,2,3,4-tetrahydro-2,2,4-trimethyl-quinolin-1-yl)ethane described in U.S. Pat. No. 3,798,031 which showed the highest sensitivities in single layer photoconductive layers consisting of about 57% wt of said 1,2,3,4,-tetrahydroquinoline compounds applied in a vinyl chloride/vinyl acetate/maleic anhydride terpolymer binder both exhibited only 3.3% discharge when evaluated in a two layer photoconductive recording material system consisting of an aluminium coated polyester film sequentially coated with a 0.6 μm thick charge generating layer consisting of 50% wt of X-phthalocyanine. 45% wt of polycarbonate and 5wt of polyester and a 15 um thick charge transport layer consisting of 50% wt of the said 1,2,3,4-tetrahydroquinoline compounds in polycarbonate under the conditions which have been applied in Example 1 described herein.

It is an object of the present invention to provide a photoconductive composite layer material comprising a charge generating layer in contiguous relationship with a charge transport layer containing an organic photoconductive compound that has a particularly high positive charge transport capacity.

It is another object of the present invention to provide a recording process wherein a charge pattern of negative charge polarity is formed on said composite layer material by negatively charging a charge transport layer containing an organic photoconductive compound and imagewise photo-exposing the charge generating layer that is in contiguous relationship with said transport layer.

Other objects and advantages of the present invention will appear from the further description and examples.

In accordance with the present invention an electrophotographic recording material is provided which comprises an electrically conductive support having thereon a charge generating layer in contiguous relationship with a charge transporting layer, characterized in that said charge transporting layer contains at least one compound having basically a N-aryl-carbazole structure, said compound having preferably a melting point of at least 30° C. more preferably of at least 100° C. and corresponding to the following general formula (1) :

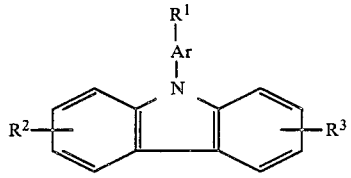

(I)

wherein:

$R^1$ is —$NR^4R^5$, wherein each of $R^4$ and $R^5$ (same or different) represents hydrogen, an aliphatic or cycloaliphatic group including said groups in substituted form, e.g. methyl or benzyl, or an aryl group e.g. phenyl, or $R^4$ and $R^5$ together represent the atoms necessary to complete a nitrogen-containing ring including such ring in substituted form, e.g. a carbazolyl ring, or $R^1$ is —N=N—Cp, wherein Cp is an azocoupler residue such as from an aromatic amine or an aromatic hydroxy compound used in azo coupling, or $R^1$ is —N CH—$R^6$, wherein $R^6$ represents an aliphatic or cycloaliphatic group including said groups in substituted form, e.g. methyl or benzyl, or an aryl group. e.g. phenyl, Ar presents a bivalent aromatic group including said group in substituted form. e.g. a phenylene group or a biphenylene group, and each of $R^2$ and $R^3$ (same or different) represents hydrogen, halogen, an alkyl group, an alkoxy group or a —$NR^7R^8$ group, wherein each of $R^7$ and $R^{18}$ (same or different) represents an aryl group, a $C_1$–$C_{10}$ alkyl group including such alkyl group in substituted form, e.g. an aralkyl group, preferably methyl, ethyl or benzyl.

The melting point of said positive charge transport compound is preferably at least 100° C. in order to prevent marked softening of the charge transport layer and diffusion of said compound out of the recording material at elevated temperature conditions.

For introducing an alkyl substituent in the amino-group of N(4-amino-aryl)carbazole any suitable alkylating agent e.g. trialkyl phosphates, alkyl sulfonates, alkyl iodides, alkyl bromides and alkyl chlorides may be used the latter preferably in conjunction with a small amount of potassium iodide.

Preferred N(4-aminoaryl)carbazole compounds for use according to the present invention are so-called "duplo-compounds containing two N(4-aminoaryl)carbazolyl groups linked through their amino nitrogen atoms by a bivalent organic group. Said duplo-compounds are within the scope of the following general formula (II):

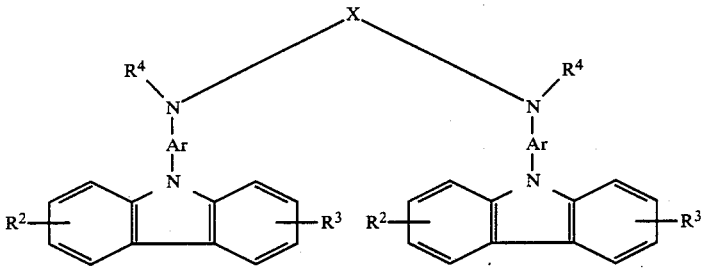

(II)

wherein:

X is a bivalent aliphatic or cycloaliphatic group of the type that can be introduced by alkylation e.g. an alkylene group, preferably an ethylene group, a substituted alkylene group or an alkylene group interrupted by a bivalent aromatic group. e.g. a phenylene, naphthalene or anthracene group, or a bivalent aliphatic group wherein at least two carbon atoms are linked through a hetero atom selected from the group consisting of oxygen, sulphur or nitrogen wherein nitrogen is substituted with a monovalent hydrocarbon group, e.g. an aryl group, and $R^2$, $R^3$ and $R^4$ have the same significance as described above.

Duplo compounds for use according to the present invention are prepared advantageously by linking together by alkylation two N(4-amino-aryl) carbazoles through their 4-amino nitrogen atoms.

As suitable bifunctional alkylating agents are mentioned dihalogenated reactants that have the formula Hal-X-Hal in which Hal represents a replaceable halogen atom e.g. chlorine, bromine or iodine and X has the same significance as described above in the duplo-compounds.

The following are illustrative of reactants that may be used in the preparation of the duplo-compounds:

ethylene dichloride, dibromide, di-iodide and di-toluene sulfonate, 1-chloro-2-bromoethane, 1-chloro-ethane-2-toluene sulfonate, propylene dichloride, dibromide, di-iodide and di-toluene sulfonate, trimethylene dichloride, dibromide, bromoiodide and di-toluene sulfonate, butylene dichloride, dibromide, di-iodide and di-toluene sulfonate, tetramethylene dichloride, dibromide di-iodide, and di-toluene sulfonate, tetramethylene dichloride, dibromide, di-iodide, and di-toluene sulfonate, pentylene dichloride, dibromide, di-iodide, and di-toluene sulfonate, hexamethylene dichloride, dibromide, di-iodide, and di-toluene sulfonate, hexylene dichloride, dibromide, di-iodide, and di-toluene sulfonate, octylene dichloride, dibromide, di-iodide, and di-toluene sulfonate, pentamethylene dichloride, dibromide, di-iodide, and di-toluene sulfonate, Alpha, Beta-styrene dichloride, dibromide, di-iodide, and di-toluene sulfonate, 1,2-dibromocyclohexane, 1,3-dibromobutane, 1,2-dibromobutane, 1,4-dichlorobutene-2, 2-phenyl-1,2-dibromopropane, 1-p-tolyl-1,2-dichloroethane, 1,4-di(chloromethyl)benzene, 1,2-di(chloromethyl)benzene, and 1,3-di(chloromethyl)benzene 1,4-di(bromomethyl)benzene, 1,2-di(bromomethyl)benzene, and 1,3-di(bromomethyl)benzene, 1,4-di(iodomethyl)benzene, 1,2-di(iodomethyl)benzene, and 1,3-di(iodomethyl)benzene, 1-(2,4-dichlorophenyl)-1,2-dichloroethane, 1-(p-chlorophenyl)-1,2-dibromoethane, decamethylene dichloride, dibromide, di-iodide and di-toluene sulfonate, dodecamethylene dichloride, dibromide, di-iodide and di-toluene sulfonate,
1,2-dibromobutene-3,
1,2-dichloropentene-4,
1,2-dichloro-3-methylbutene-3,
1,4-dichlorobutene-2,
1,4-dibromo-2,3-dimethylbutene-2,
1,2-dichlorocyclopentene-3,
1,4-dibromo-2,6-dimethylheptene-2, and
2,3-dichloro-2,6-dimethyloctene-6.

Other suitable reactants for duplo-compound formation are the Beta-chloroethyl ester of p-toluenesulfonic acid and the p-toluenesulfonic acid glycol diester.

Preferred reactants are sym.-dibromoethane, sym.-dichloroethane and 1-chloro-ethane-2-toluenesulfonate.

The acid produced during the alkylation reaction may be neutralized by any alkaline neutralizing agent ordinarily employed for neutralizing acids produced in condensation reactions e.g. an organic base.

A detailed description of the preparation of most of the N(4-amino-aryl)carbazole compounds including the duplo-compounds is given in detail in U.S. Pat. No. 3 912,509.

Specific examples of compounds suited for use according to the present invention are listed in the following Table 1 with their melting points.

TABLE 1

| No. | Formula | Melting point °C. |
|---|---|---|
| 1 | 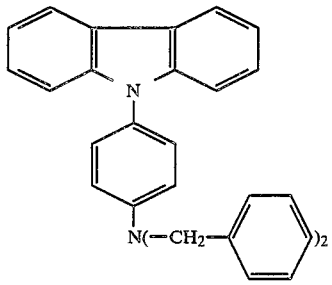 | 184 |
| 2 | 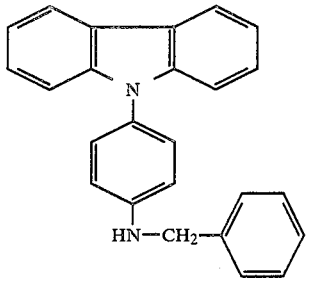 | 129 |
| 3 | 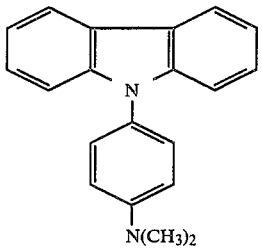 | 212 |
| 4 | 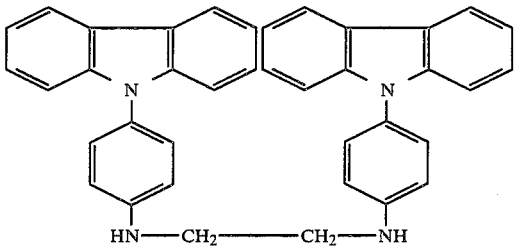 | 231 |

TABLE 1-continued
| No. | Formula | Melting point °C. |
|---|---|---|
| 5 | 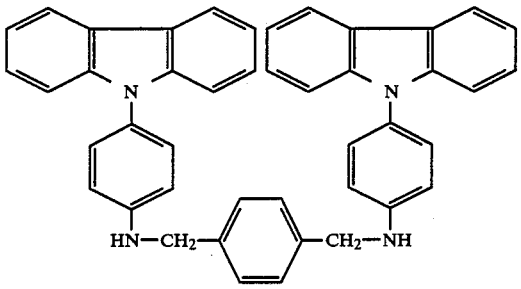 | 205 |
| 6 | 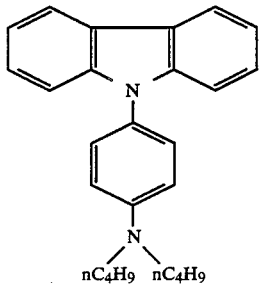 | 77 |
| 7 | 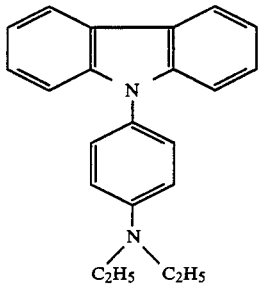 | 146 |
| 8 | 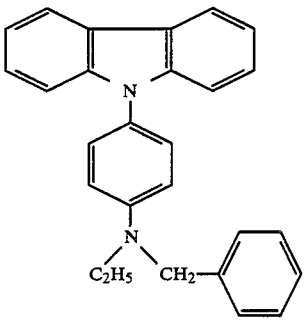 | 94 |
| 9 | 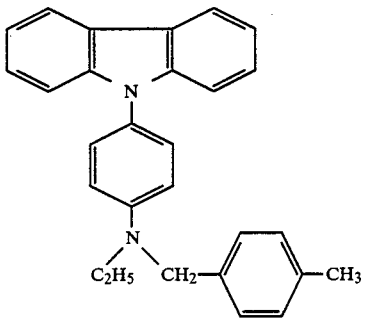 | oil at 20° C. |

TABLE 1-continued
| No. | Formula | Melting point °C. |
|---|---|---|
| 10 | 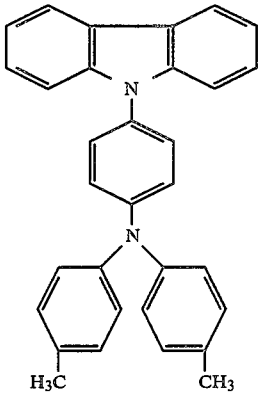 | 213 |
| 11 | 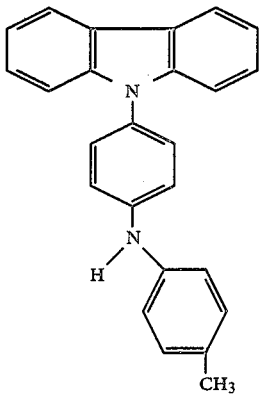 | 172 |
| 12 | 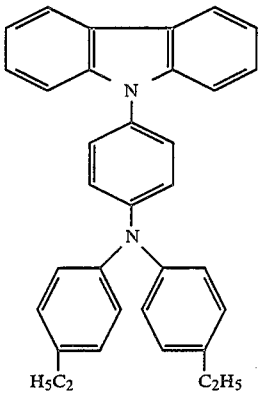 | 126–132 |
| 13 | 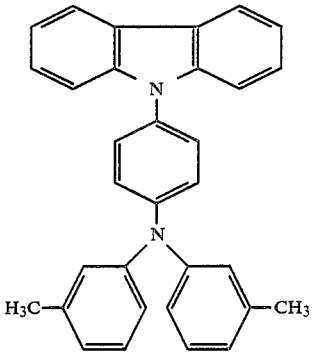 | 172 |

TABLE 1-continued
| No. | Formula | Melting point °C. |
|---|---|---|
| 14 | 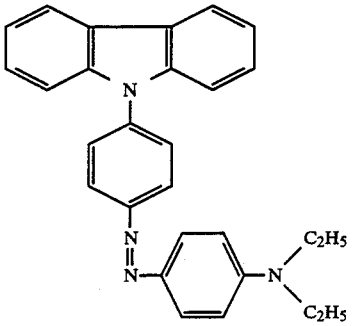 | 173 |
| 15 | 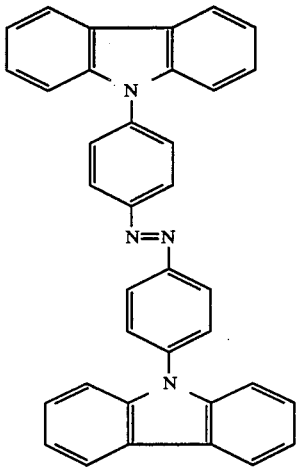 | >260 |
| 16 | 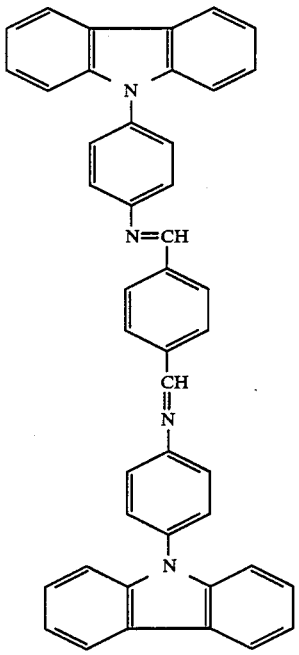 | >260 |

TABLE 1-continued
| No. | Formula | Melting point °C. |
|---|---|---|
| 17 | 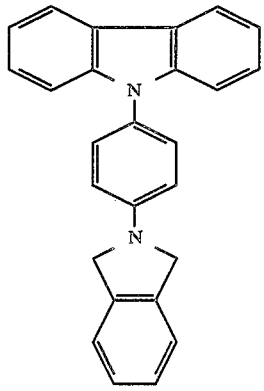 | >260 |
| 18 | 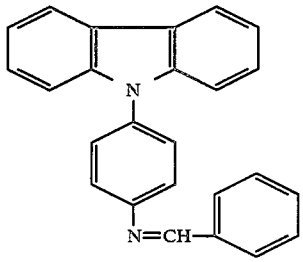 | 123 |
| 19 | 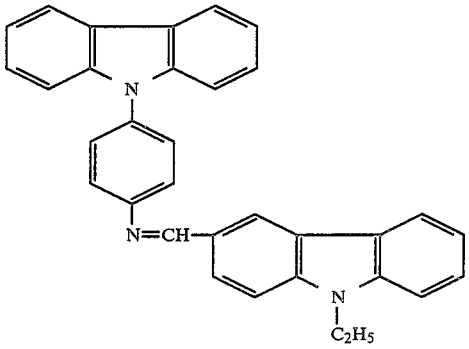 | 200 |
| 20 | 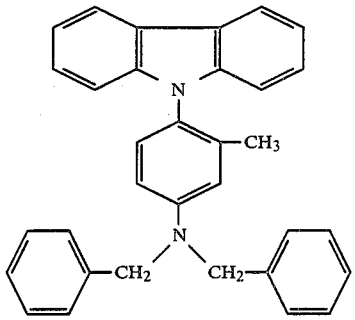 | 191 |
The preparation of the intermediate N(4-nitroaryl)-carbazole derivative proceeds advantageously by reacting a 4-nitroaryl halide in the presence of dried $K_2CO_3$ with carbazole. This reaction is illustrated by the following reaction scheme:
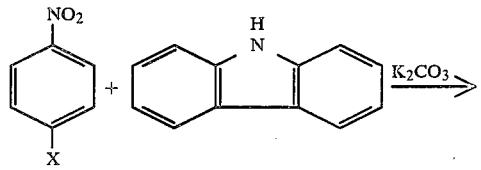

-continued

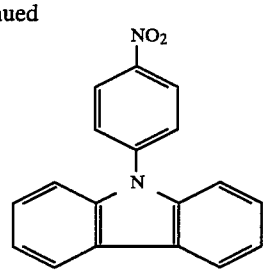

X is halogen.

The N-(4-nitroaryl)carbazole can be advantageously reduced to the corresponding N-(4-aminoaryl)carbazole compound by hydrogenation in a suitable solvent in the presence of Raney nickel.

The introduction of the substituents $R^4$ and $R^5$ replacing the hydrogen in the $NH_2$ group of the N-(4-aminoaryl)carbazole may proceed according to known alkylation techniques.

The preparation of intermediary compounds and the preparation of compounds No. 2, 8 and 10 is given hereinafter in detail for illustrative purposes.

Preparation of 9-(4-nitrophenyl)carbazole (Compound A)

A mixture of 334.4 (2 mol) of carbazole, 472.8 g of p-chloro-nitrobenzene (3 mol) and 691 g (5 mol) of anhydrous potassium carbonate were stirred in 1500 ml of dimethylacetamide for 13 h at reflex temperature. The reaction mixture was then poured into 7 of water and the precipitate separated by suction filtering. Said precipitate was stirred in 4 of water and neutralized with 1 N hydrochloric acid, whereupon the precipitate was filtered again. After drying the solid product was recrystallized from a mixture of tetrahydrofuran and methanol and the yellow product obtained was dried. Yield: 465 g. Melting point: 211° C.

Preparation of 9-(4-aminophenyl)carbazole (Compound B)

134 g of 9-(4-nitrophenyl)-carbazole, 9.3 ml Raney nickel and 876 m of 2-methoxypropanol were introduced into a 3 shaking autoclave. The reduction was carried out at a hydrogen pressure of 60 bar at 60° C. After 1 h of shaking the reduction was complete. The Raney nickel was filtered and the filtrate was concentrated by evaporation. A viscous oil was left which upon careful drying in a ventilated stove yielded a solid. Yield: 110 g. Melting point: 82° C.

Preparation of intermediate compound (Compound C) of structure:

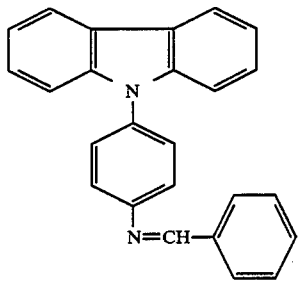

A mixture of 12.9 g (0.05 mol) of 9-(4-aminophenyl)-carbazole, 6.2 g (0.05 mol) of benzaldehyde and 0.1 ml of methanesulphonic acid in 800 ml of toluene were refluxed for 4 h. After evaporating the solvent the residue obtained was recrystallized from acetonitrile. Yield 15 g. Melting point 121° C.

Preparation of Compound No. 2.

103.8 g (0.3 mol) of compound C was mixed with 500 ml of ethanol and 500 ml of tetrahydrofuran at 40° C. 19 g (0.5 mol) of $NaBH_4$ were added portionwise to this mixture over a period of 10 minutes and the resulting mixture was heated for 3 h at 60° C. This was then neutralized with acetic acid and diluted with 500 ml of water. The resulting precipitate was filtered off and stirred in 500 ml of ethanol. Yield: 92 g. Melting point: 129° C.

Preparation of Compound No. 8

A mixture of 20.9 g (0.06 mol) of compound No. 2, 13.8 g (0.1 mol) of anhydrous potassium carbonate and 9.4 ml (0.12 mol) of ethyl iodide in 125 ml of methylethylketone were refluxed for 72 h. The inorganic residue was removed by filtration and the filtrate was diluted with water. The resulting precipitate was purified by column chromatography and recrystallyzed from acetonitrile. Yield: 16.8 g. Melting point: 94° C.

Preparation of Compound No. 10

25.8 g (0.1 mol) of 9-(4-aminophenyl)carbazole,
54.5 g (0.25 mol) of p-iodotoluene,
5.1 g (0.08 mol) of copper-bronze,
55.2 g (0.4 mol) of anhydrous $K_2CO_3$,
5.3 g (0.02 mol) of 18-crown-6-ether, and
300 ml of o-dichlorobenzene were put in a reaction flask.

The reaction mixture was refluxed for 15 h, and the water formed was removed with a Dean and Stark apparatus. The inorganic residue was then filtered off and the filtrate concentrated by evaporation. The residue was recrystallized from 2-ethoxy-propanol. Yield: 31 g. Melting point: 213° C.

For the production of a recording material according to the present invention at least one N-aryl-carbazole compound according to general formula (1) is utilized in combination with a resin binder to form a charge transporting layer adhering directly to a charge generating layer with one of the two layers being in direct contact with an electrically conductive support. Through the resin binder the charge transporting layer obtains sufficient mechanical strength and obtains or retains sufficient capacity to hold an electrostatic charge for copying purposes. Preferably the specific resistivity of the charge transporting layer is not lower than $10^9$ ohm.cm. The resin binders are selected in view of optimal mechanical strength, adherence to the charge generating layer and favourable electrical properties.

Suitable electronically inactive binder resins for use in the charga transporting layer are e.g. cellulose esters, acrylate and methacrylate resins, e.g. cyanoacrylate resin, polyvinyl chloride, copolymers of vinyl chloride, e.g. copolyvinyl/acetate and copolyvinyl/maleic anhydride, polyester resins, e.g. copolyesters of isophthalic acid and terephthalic acid with glycol or aromatic polycarbonate resins.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of the following general formula (III):

(III)

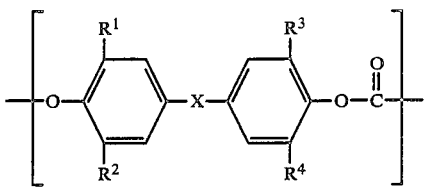

wherein:

X represents S, $SO_2$,

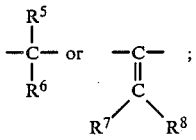

$R^1$, $R^2$, $R^3$, $R^4$, $R^7$ and $R^8$ each represents (same or different) hydrogen, halogen, an alkyl group or an aryl group, and $R^5$ and $R^6$ each represent (same or different) hydrogen, an alkyl group, an aryl group or together represent the necessary atoms to close a cycloaliphatic ring. e.g. cyclohexane ring.

Aromatic polycarbonates having a molecular weight in the range of 1000 to 200,000 are preferred. Suitable polycarbonates having such high molecular weight are sold under the registered trade mark MAKROLON of Farbenfabriken Bayer AG. W-Germany.

MAKROLON CD 2000 (registered trade mark) is a bisphenol A polycarbonate with molecular weight in the range of 12,000 to 25,000 wherein $R^1=R^2=R^3=R^4=H$ and X is $R^5—C—R^6$ with $R^5=R^6=CH_3$.

MAKROLON 5700 (registered trade mark) is a bisphenol A polycarbonate with molecular weight in the range of 50.000 to 120,000 wherein $R^1=R^2=R^3=R^4=H$ and X is $R^5—C—R^6$ with $R^5=R^6=CH_3$.

Bisphenol Z polycarbonate is an aromatic polycarbonate containing recurring units wherein $R^1=R^2=R^3=R^4=H$, X is $R^5—C—R^6$, and $R^5$ together with $R^6$ represents the necessary atoms to close a cyclohexane ring.

Further useful binder resins are silicone resins, polystyrene and copolymers of styrene and maleic anhydride and copolymers of butadiene and styrene.

An example of an electronically active resin binder is poly-N-vinylcarbazole or copolymers of N-vinylcarbazole having a N-vinylcarbazole content of at least 40% by weight.

The ratio wherein the charge-transporting N-(4-aryl-amino)carbazole compound or compounds and the resin binder are mixed can vary. However, relatively specific limits are imposed, e.g. to avoid crystallization. The content of the N-(4-aryl-amino)carbazole(s) used according to the present invention in a positive charge transport layer is preferably in the range of 30 to 70% by weight with respect to the total weight of said layer. The thickness of the charge transport layer is in the range of 5 to 50 um, preferably in the range of 5 to 30 um.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain organic compounds containing electron-acceptor groups forming an intermolecular charge transfer complex, i.e. donor-acceptor complex wherein the N-(4-aryl-amino)-carbazole represents a donor compound by the presence of its electron donating substituted 4-amino and ring nitrogen. Useful compounds having electron-accepting groups are nitrocellulose and aromatic nitro-compounds such as nitrated fluorenone-9 derivatives. nitrated 9-dicyanomethylenefluorenone derivatives, nitrated naphthalenes and nitrated naphthalic acid anhydrides or imide derivatives. The optimum concentration range of said derivatives is such that the molar donor-/acceptor ratio is 10:1 to 1,000:1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

The charge transport layer used in the recording material according to the present invention possesses the property of offering a high charge transport capacity coupled with a low dark discharge. While with the common single layer photoconductive systems an increase in photosensitivity is coupled with an increase in the dark current and fatigue such is not the case in the present double layer arrangement wherein the functions of charge generation and charge transport are separated and a photosensitive charge generating layer is arranged in contiguous relationship with a charge transporting layer.

As charge generating compounds for use in a recording material according to the present invention any of the organic pigment dyes belonging to one of the classes a) to n) mentioned hereinbefore may be used. Further examples of pigment dyes useful for photogenerating positive charge carriers are disclosed in U.S. Pat. No. 4,365,014.

Inorganic substances suited for photogenerating positive charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

Said photoconductive substances functioning as charge generating compounds may be applied to a support with or without a binding agent. For example, they are coated by vacuum-deposition without binder as described e.g. in U.S. Pat. Nos. 3,972,717 and 3,973,959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. The binding agent(s) may be the same as the one(s) used in the charge transport layer which normally provides best adhering contact. In some cases it may be advantageous to use in one or both of said layers a plasticizing agent, e.g. halogenated paraffin, polybiphenyl chloride, dimethylnaphthalene or dibutyl phthalate.

The thickness of the charge producing layer is preferably not more than 5 μm. more preferably not more than 2 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as blocking layer preventing positive or negative charge injection from the support side. The thickness of said barrier layer is preferably not more than 1 micro.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh Pa., U.S.A.) described in U.S. Pat. No. 3,832,171.

The support may be in the form of a foil, web or be part of a drum.

An electrophotographic recording process according to the present invention comprises the steps of:

(1) overall negatively electrostatically charging, e.g. with corona-device, the charge transporting layer or charge generating layer of the recording material of the present invention, (2) image-wise photo-exposing the charge generating layer of the recording material according to the present invention thereby obtaining a latent electrostatic image.

The photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography" — The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation. e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof. For light in the spectral range beyond 800 nm e.g. naphthalocyanines having siloxy groups bonded to the central metal silicon can be used as charge generating substance (ref. published EP-A No. 0 243 205).

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out as follows:

The photoconductive recording sheet material was mounted with its conductive backing on an aluminium drum which was earthed and rotated at a circumferential speed of 10 cm/s. The recording material was sequentially charged with a negative corona at a voltage of −4.6 kV operating with a corona current of about 1 μA per cm of corona wire. Subsequently the recording material was exposed (simulating image-wise exposure) with a light dose corresponding to 12.3 mJ/m2 of 650 mm light obtained from a monochromator positioned at the circumference of the drum at an angle of 45° with respect to the corona source. The photo-exposure lasted 200 ms. Thereupon, the exposed recording material passed an electrometer probe positioned at an angle of 180° with respect to the corona source.

After effecting an overall post-exposure with a halogen lamp producing 27.000 mJ/m2 positioned at an angle of 270° with respect to the corona source a new copying cycle started.

Each measurement relates to 100 copying cycles in which 10 cycles without 650 nm light exposure are alternated with 5 cycles with 650 nm light exposure.

The charging level (CL) is taken as the average charging level over the 90th to 100th cycle, the residual potential (RP) as the average residual potential over the 85th to 90th cycle, the % discharge as $$\frac{(CL - RP)}{CL} \times 100$$

and the fatigue (F) as the difference in residual potential in volts between RP and the average residual potential over the 10th to 15th cycle.

For a given corona voltage, corona current, separating distance of the corona wires to recording surface and drum circumferential speed the charging level CL is only dependent upon the thickness of the charge transport layer and its specific resistivity. In practice CL expressed in volts should be preferably ≧30 d, where d is the thickness in μm of the charge transport layer.

Under the applied exposure conditions, simulating practical copying conditions, and by using a charge transport layer in conjunction with a charge generating layer on the basis of X-phthalocyanine as the charge generating pigment, the % discharge should be at least 35% and preferably at least 50%. The fatigue F should preferably not exceed 20V either negative or positive to maintain a uniform image quality over a large number of copying cycles.

All ratios and percentages mentioned in the following examples are hy weight.

EXAMPLES 1 to 10

The photoconductor sheets were produced by coating a 100 μm thick polyester film vapour-coated with a conductive layer of aluminium with a dispersion of charge generating pigment to a thickness of 0.55 um with a doctor-blade coater.

Said dispersion was prepared by mixing 1 g of metal-free purified X-phthalocyanine, 0.1 9 g of a polyester adhesion-promoting additive DYNAPOL L 206 (registered trade mark), 0.9 g of MAKROLON CD 2000 (registered trade mark) and 23 g of dichloromethane for 20 minutes in a pearl mill, which dispersion before coating was diluted with 8 g of dichloromethane to the required coating viscosity.

The applied layer was dried for 15 minutes at 80° C. and then overcoated using a doctor-blade coater to a thickness of 12 μm with a filtered solution of charge transporting material and binder consisting of 2 g of the compound indicated for the appropriate example in Table 2, 2 g of MAKROLON CD 2000 (registered trade mark) and 26.3 g of dichloromethane. These layers were then dried for 16 hours at 50° C.

The characteristics of the thus obtained photoconductive recording material were determined as described above and are given in Table 2 below:

TABLE 2

| Example No. | Compound No. | CL [V] | RP [V] | % Discharge | F [V] |
|---|---|---|---|---|---|
| 1 | 1 | −678 | −239 | 64.7 | +27 |
| 2 | 2 | −711 | −410 | 42.3 | +11 |
| 3 | 5 | −1099 | −1059 | 3.6 | −360 |
| 4 | 6 | −703 | −455 | 35.3 | −56 |

TABLE 2-continued

| Example No. | Compound No. | CL [V] | RP [V] | % Discharge | F [V] |
|---|---|---|---|---|---|
| 5 | 7 | −720 | −515 | 28.5 | −38 |
| 6 | 8 | −616 | −255 | 58.6 | +28 |
| 7 | 12 | −582 | −421 | 27.7 | +15 |
| 8 | 13 | −704 | −548 | 22.2 | −38 |
| 9 | 14 | −702 | −398 | 43.3 | −49 |
| 10 | 20 | −675 | −514 | 23.8 | −24 |

EXAMPLES 11 to 19

A photoconductive recording sheet was produced as described in Examples 1 to 10 except that the charge transporting layer consisted of 50% of 4,10-dibromoanthanthrone in MAKROLON CD 2000 (registered trade mark) instead of 50% of X-phthalocyanine in MAKROLON CD 2000 (registered trade mark) and that the charge transporting layer consisted of the compound indicated for the appropriate example in Tables 3 and 4 at the concentration indicated in said Tables in MAKROLON CD 2000 (registered trade mark).

The characteristics of the thus obtained photoconductive recording material were determined as described in Examples 1 to 10 except that for Examples 11 and 12 they were exposed to 19.1 mJ/m2 of 540 nm light instead of 13.2 mJ/m$^2$ of 650 nm light and for Examples 13 to 19 they were exposed to 6.0 mJ/m$^2$ of 540 nm light instead of 13.2 mJ/m$^2$ at 650 nm light. The characteristics determined are given in Tables 3 and 4 below:

TABLE 3

| Example | Compound No. | Compound conc. in wt % | CL [V] | RP [V] | % Discharge | F [V] |
|---|---|---|---|---|---|---|
| 11 | 1 | 40 | −790 | −180 | 77.2 | 0 |
| 12 | 2 | 50 | −746 | −340 | 54.4 | +36 |

TABLE 4

| Example | Compound No. | Compound conc. in wt % | CL [V] | RP [V] | % Discharge | F [V] |
|---|---|---|---|---|---|---|
| 13 | 1 | 50 | −760 | −450 | 40.8 | −9 |
| 14 | 5 | 50 | −1079 | −1046 | 3.1 | −326 |
| 15 | 6 | 50 | −769 | −533 | 30.7 | −64 |
| 16 | 7 | 50 | −728 | −516 | 29.1 | −40 |
| 17 | 8 | 50 | −737 | −393 | 46.7 | −10 |
| 18 | 12 | 50 | −670 | −466 | 30.4 | +2 |
| 19 | 13 | 50 | −781 | −609 | 22.0 | −26 |

EXAMPLE 20

A photoconductive recording sheet was produced as described in Example 13 except that the concentration of compound 1 in the charge transporting layer was 40% instead of 50% and that MAKROLON CD 2000 registered trade mark) in both the charge transporting and charge generating layer had been replaced by poly[bis-1,1'-(4-hydroxyphenyl)-1-phenylethane-carbonate]. Said polymer having a weight average molecular weight of 36,900 and a number averaged molecular weight of 15,000.

The characteristics of this obtained photoconductive recording material were determined as described for Example 13 with the following results:

CL = −783V

RP=−452V
% discharge=42.3%
F=−9V

EXAMPLE 21

A photoconductive recording sheet was produced as described in Example 20 except that the poly[bis-1,1'-(4-hydroxyphenyl)-1-phenylethane-carbonate] in both the charge transporting and charge generating layer had been replaced by poly[bis-1,1'-(4-hydroxy-3,5-dimethyl-phenyl)2-propylcarbonate].

The characteristics of the thus obtained photoconductive recording material were determined as described in Example 13 with the following results:

CL=−784V
RP=−537V
% discharge=31.5%
F=−18V

EXAMPLE 22

A photoconductive recording sheet was produced as described in Example 20 except that the poly[bis-1,1'-(4-hydroxyphenyl)-1-phenylethane-carbonate] in both the charge transporting and charge generating layer had a weight averaged molecular weight of 39,900 and a number averaged molecular weight of 15,300.

The characteristics of the thus obtained photoconductive recording material were determined as described for Example 13 with the following results:

CL=−776V
RP=−449V
% discharge=42.1%
F=−27V

EXAMPLE 23

A photoconductive recording sheet was produced as described in Example 20 except that the poly[bis-1,1'-(4-hydroxyphenyl)-1-phenylethane-carbonate] in both the charge transporting and charge generating layer had been replaced by a 80% [bis-1,1'-(4-hydroxy-3,5-dimethyl-phenyl)-2-propylcarbonate]— 20% bis-1,1'-(4-hydroxyphenyl)-2-propylcarbonate] copolymer having a weight averaged molecular weight of 27,880 and a number averaged molecular weight of 11,710.

The characteristics of this photoconductive recording layer were determined as described above for Example 13 with the following results:

CL=−783V
RP=−525V
% discharge=32.9%
F=−40V

We claim:

1. An electrophotographic recording material which comprises an electrically conductive support having thereon a charge generating layer in contiguous relationship with a charge transporting layer, characterized in that said charge transporting layer contains at least one compound having basically a N-aryl-carbazole structure, said compound having a melting point of at least 30° C. and corresponding to the following general formula (I):

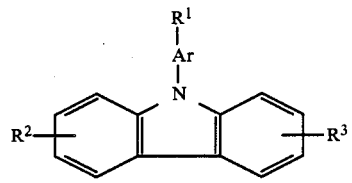

(I)

wherein:

$R^1$ is —$NR^4R^5$, wherein each of $R^4$ and $R^5$ (same or different) represents hydrogen, an aliphatic or cycloaliphatic group including said groups in substituted form or an aryl group, or $R^4$ and $R^5$ together represent the atoms necessary to complete a nitrogen-containing ring including such ring in substituted form, or $R^1$ is —N=N—Cp, wherein Cp is an azocoupler residue derived from an aromatic amine or an aromatic hydroxy compound used in azo coupling, or $R^1$ is —N=CH—$R^6$, wherein $R^6$ represents an aliphatic or cycloaliphatic group including said groups in substituted form, or an aryl group, Ar presents a bivalent aromatic group including said group in substituted form, and each of $R^2$ and $R^3$ (same or different) represents hydrogen, halogen, an alkyl group, an alkoxy group or a —$NR^7R^8$ group, wherein each of $R^7$ and $R^{18}$ same or different) represents an aryl group, a $C_1$–$C_{10}$ alkyl group including such alkyl group in substituted form.

2. An electrophotographic recording material according to claim 1, wherein the compound according to general formula (I) has a melting point of at least 100° C.

3. An electrophotographic recording material according to claim 1, wherein $R^4$ and $R^5$ each represents an alkyl group or substituted alkyl group introduced by alkylation.

4. An electrophotographic recording material according to claim 1, wherein each of $R^4$ and $R^5$ represents a benzyl group.

5. An electrophotographic recording material according to claim 1, wherein said N-aryl-carbazole compound is a compound within the scope of the following general formula (II):

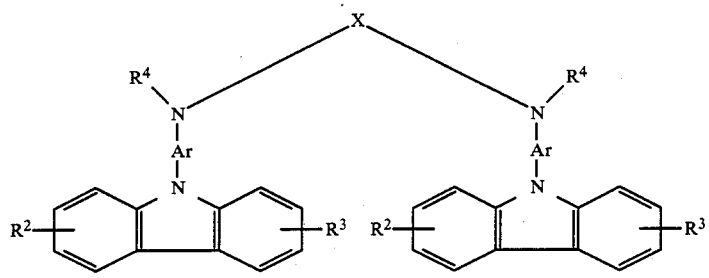

(II)

wherein:

X is an alkylene group, a substituted alkylene group or an alkylene group interrupted by a bivalent aromatic group or a bivalent aliphatic group wherein at least two carbon atoms are linked through a hetero atom selected from the group consisting of oxygen, sulphur or nitrogen wherein nitrogen is substituted with a monovalent hydrocarbon group, and $R^2$, $R^3$ and $R^4$ have the same significance as in claim 1.

6. An electrophotographic recording material according to claim 1, wherein said N-aryl-carbazole compound is applied in combination with a resin binder to form a charge transporting layer adhering directly to said positive charge generating layer with one of the two layers being itself carried by an electrically conductive support.

7. An electrophotographic recording material according to claim 6, wherein the resin binder is selected from the group consisting of a cellulose ester, acrylate or methacrylate resin, polyvinyl chloride, copolymer of vinyl chloride, polyester resin an aromatic polycarbonate resin, silicone resin, polystyrene, a copolymer of styrene and maleic anhydride, a copolymer of butadiene and styrene, poly-N-vinylcarbazole and a copolymer of N-vinylcarbazole having a N-vinylcarbazole content of at least 40% by weight.

8. An electrophotographic recording material according to claim 6, wherein the content of said N-arylcarbazole compound in the charge transporting layer is in the range of 30 to 70 by weight with respect to the total weight of said layer.

9. An electrophotographic recording material according to claim 1, wherein the charge generating layer contains for photo-induced electron-positive hole pair formation an organic substance selected from the group consisting of:

(a) perylimides,
(b) polynuclear quinones,
(c) quinacridone,
(d) naphthalene 1,4,5,8 tetracarboxylic acid derived pigments,
(e) phthalocyanines,
(g) benzothioxanthene-derivatives.
(h) perylene 3,4,9,10-tetracarboxylic acid derived pigments,
(i) polyazo pigments, and
(j) squarilium dyes.
(k) polymethine dyes.
(l) dyes containing quinazoline groups,
(m) triarylmethane dyes, and
(n) dyes containing 1,5-diamino-anthraquinone groups.

10. An electrophotographic recording material according to claim 1, wherein the conductive support is made of aluminium, steel, brass or paper or resin material incorporating or being coated with a conductivity enhancing substance, the support being in the form of a foil, web or being part of a drum.

* * * * *